US009216577B2

(12) United States Patent
Stolk et al.

(10) Patent No.: US 9,216,577 B2
(45) Date of Patent: Dec. 22, 2015

(54) DROPLET EJECTION DEVICE

(71) Applicant: OCE-TECHNOLOGIES B.V., Venlo (NL)

(72) Inventors: Hendrik J. Stolk, Bergen (NL); Alex N. Westland, Baarlo (NL); Hans Reinten, Velden (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/563,501

(22) Filed: Dec. 8, 2014

(65) Prior Publication Data

US 2015/0091982 A1 Apr. 2, 2015

Related U.S. Application Data

(63) Continuation of application No. PCT/EP2013/060062, filed on May 15, 2013.

(30) Foreign Application Priority Data

Jun. 8, 2012 (EP) ..... 12171234

(51) Int. Cl.
*B41J 2/14* (2006.01)

(52) U.S. Cl.
CPC ..... *B41J 2/1433* (2013.01); *B41J 2002/14475* (2013.01); *B41J 2202/07* (2013.01)

(58) Field of Classification Search
CPC ..... B41J 2/14; B41J 2/16
See application file for complete search history.

(56) References Cited

U.S. PATENT DOCUMENTS

| | | | | |
|---|---|---|---|---|
| 6,089,698 | A * | 7/2000 | Temple et al. | 347/47 |
| 6,491,376 | B2 * | 12/2002 | Trauernicht et al. | 347/47 |
| 2008/0088669 | A1 | 4/2008 | Shimura | |
| 2009/0225131 | A1 * | 9/2009 | Chen et al. | 347/44 |
| 2014/0210910 | A1 * | 7/2014 | Freriks et al. | 347/47 |

FOREIGN PATENT DOCUMENTS

| | | | |
|---|---|---|---|
| DE | 10 2010 028 435 | A1 | 11/2010 |
| EP | 0 337 429 | A2 | 10/1989 |
| EP | 1 424 204 | A1 | 6/2004 |
| WO | 93/15911 | A1 | 8/1993 |

* cited by examiner

*Primary Examiner* — Stephen Meier
*Assistant Examiner* — John P Zimmermann
(74) *Attorney, Agent, or Firm* — Birch, Stewart, Kolasch & Birch, LLP

(57) ABSTRACT

A droplet ejection device includes a pressure chamber; a nozzle orifice arranged in fluid connection with the pressure chamber; an actuator system for generating a pressure wave in a liquid present in the pressure chamber; and an obstruction member arranged in the pressure chamber in a position opposite to the nozzle orifice. The obstruction member comprises a first surface facing the nozzle orifice and rigidly coupled to a wall of the pressure chamber via a support. The support is arranged near the first surface of the obstruction member. The droplet ejection device according to the present invention may further comprise a structured nozzle inflow means which provides a gradual transition from the hollow shaped liquid passage to the nozzle orifice. The droplet ejection device prevents or at least mitigates air entrapment in dead volumes present in the interior of the droplet ejection device.

14 Claims, 12 Drawing Sheets

DROPLET EJECTION DEVICE

CROSS-REFERENCE TO RELATED APPLICATIONS

This application is a Continuation of International Application No. PCT/EP2013/060062, filed on May 15, 2013, and for which priority is claimed under 35 U.S.C. §120. PCT/EP2013/060062 claims priority under 35 U.S.C. §119(a) to Application No. 12171234.3, tiled in Europe on Jun. 8, 2012. The entire contents of each of the above-identified applications are hereby incorporated by reference into the present application.

BACKGROUND OF THE INVENTION

1. Field of the Invention

The present invention relates to a droplet ejection device comprising a pressure chamber, a nozzle orifice in fluid connection with the pressure chamber, and an actuator system for generating a pressure wave in the liquid in the pressure chamber.

2. Description of Background Art

Droplet ejection devices are used, for example, in ink jet printers for ejecting ink droplets onto a recording medium. The actuator system may, for example, comprise a piezoelectric actuator that, when energized, performs a contraction stroke followed by an expansion stroke so as to generate an acoustic field primarily in an ejection liquid (e.g. ink present in the pressure chamber and resulting in a droplet of the ejection liquid (e.g. an ink droplet) being ejected from the nozzle orifice.

It is a disadvantage of droplet ejection devices that air bubbles can easily enter into the pressure chamber via the nozzle orifice. In particular, when after droplet ejection, the liquid-air interface (e.g. the ink meniscus) moves back into the interior of the droplet ejection device due to a residual pressure wave that propagates through the liquid (e.g. ink). If the liquid-air interface moves relatively far into the interior of the droplet ejection device, the surface energy of the liquid-air interface may cause formation of air bubbles in the liquid. The presence of air-bubbles may negatively influence the jetting stability and is therefore an undesired phenomenon. Maintenance actions (e.g. purging) may be required to remove air bubbles before the jetting process can be reliably resumed.

In order to avoid entrapped air, a nozzle orifice design comprising a gradual geometric transition from the nozzle orifice towards the pressure chamber may be used. Such geometry also provides smooth guidance of a liquid from the pressure chamber to the nozzle orifice, optionally via a feed-through channel arranged as a part of the pressure chamber and extending towards the nozzle orifice, From a manufacturing point of view, such nozzle orifice design is less preferred, because a large number of processing steps is involved in manufacturing such nozzle orifices. Moreover, the allowable geometrical tolerances of such nozzle orifice designs in order to meet the jetting requirements (e.g. jetting angle and jetting stability) are small, which are difficult to obtain with such a multi-step processing.

From the manufacturing point of view, straight nozzle orifices having a first dimension $S_1$ (e.g. for a cylindrical nozzle, a first diameter $d_1$) connected to a straight feed-through channel having a second dimension $S_2$ (e.g. for a cylindrical feed-through channel, a second diameter $d_2$), wherein $S_2$ is larger than $S_1$ ($d_2>d_1$), is preferred. In such a configuration, the geometrical transition between the nozzle orifice and the feed-through channel comprises a discrete step. Manufacturing such nozzle orifice and feed-through channel designs comprises less process steps and the geometrical tolerance on the connection between the nozzle orifice and the feed-through channel is less critical.

A disadvantage of droplet ejection devices having straight nozzle orifices connected to a straight feed-through channel is that air bubbles that have entered the pressure chamber via the nozzle orifice may be difficult to be removed. Without wanting to be bound to any theory, this may be caused by the presence of dead volumes in a feed-through channel that is connected to a straight nozzle. If the entered air bubbles end up in said dead volumes, they may be more or less permanently entrapped or at least difficult to be removed.

U.S. Application Publication No 2008/0088669 A1 discloses a nozzle plate comprising nozzle orifices having a first cylindrical columnar part and a second cylindrical columnar part, the first columnar part having a larger diameter than the second columnar part. The second columnar part is arranged for discharging droplets. A droplet guidance part having a cylindrical columnar shape is coaxially arranged in the first columnar part and supported by a first support.

The first and the second columnar parts are manufactured separately from the droplet guidance part and assembled afterwards. The first support supporting the droplet guidance part is fixed to the first columnar part.

A disadvantage of the nozzle plate design disclosed in U.S. Application Publication No. 200810088669 A1 is that the droplet guidance part is only supported at a first end of the droplet guidance part, the first end being opposite to a second end of the droplet guidance part, which second end faces the nozzle orifice. The droplet guidance part therefore has a free end (i.e. unsupported) facing the nozzle orifice, i.e. the second end of the droplet guidance part. In operation, the free end of the droplet guidance part may freely move (e.g. vibrate), which may cause jet instabilities. Due to said free movement, sucked in air bubbles may be broken down into small air bubbles, which are difficult to be removed.

Another disadvantage of the nozzle plate design disclosed in U.S. Application Publication No. 2008/0088669 A1 is that the first and the second columnar parts are manufactured separately from the droplet guidance part and assembled afterwards, which is a rather complex manufacturing process comprising alignment steps that may introduce alignment errors.

SUMMARY OF THE INVENTION

It is therefore an object of the present invention to provide a droplet ejection device having a simple and easy to manufacture nozzle design in which air entrapment is avoided and/or entrapped air can be easily removed by a standard maintenance action, such as purging.

The object is at least partly achieved by providing a droplet ejection device comprising: a pressure chamber; a nozzle orifice arranged in fluid connection with the pressure chamber; an actuator system configured to generate a pressure wave in a liquid in the pressure chamber; and an obstruction member arranged in the pressure chamber in a position opposite to the nozzle orifice, wherein the obstruction member comprises a first surface facing the nozzle orifice, wherein the obstruction member is rigidly coupled to a wall of the pressure chamber via a support, the support being arranged near the first surface of the obstruction member.

The obstruction member present in the droplet ejection device according to the present invention is rigidly coupled to a wall of the pressure chamber via a support in such a way that the support is arranged near the first surface of the obstruction member that faces the nozzle orifice. Therefore, the obstruction member does not have a free end facing the nozzle orifice as described above. The absence of said free end prevents or at least mitigates jet instabilities caused by free movement of the free end.

The nozzle orifice may be arranged for ejecting droplets of the liquid in a first direction and the obstruction member may be arranged for providing a flow of the liquid to the nozzle orifice in a second, substantially radial direction, the second direction being at a first angle θ to the first direction. In an embodiment, the first angle θ is between 70° and 110°, preferably between 75° and 105°, more preferably between 80° and 100°. In particular, the second direction is substantially perpendicular to the first direction. Substantially perpendicular in the context of the present invention should be construed as being at a first angle θ of between 80° and 100°, preferably between 85° and 95°, more preferably between 87° and 93°, more in particular 90°±0.5°.

The obstruction member present in the droplet ejection device according to the present invention provides a controlled brake for the entering liquid-air interface and prevents the liquid-air interface from moving too far into the interior of the droplet ejection device, thereby significantly reducing the risk of air-bubble formation.

In an embodiment, the pressure chamber, the obstruction member and the support define a hollow shaped liquid passage. The cross section of the hollow shaped liquid passage may have any desired shape and is defined by the combination of the cross sectional shape of the pressure chamber (or at least the cross sectional shape of the part of the pressure chamber wherein the obstruction member is arranged) and the cross sectional shape of the obstruction member. For example, if the cross section of the pressure chamber and the cross section of the obstruction member are both circular, and the obstruction member and the pressure chamber are arranged concentric relative to each other, the cross section of the hollow shaped liquid passage may be a circular ring.

In an embodiment, the pressure chamber comprises a liquid chamber arranged between the first surface of the obstruction member (facing the nozzle orifice) and the nozzle orifice. The liquid chamber may act as an air-bubble-catcher.

An additional advantage of the droplet ejection device according to the present invention is that a flow of ejection liquid (e.g. ink) in the hollow shaped liquid passage is forced along the obstruction member such that dead volumes are reduced. Therefore, air bubbles that are formed can be easily removed through the nozzle orifice during jetting or by simple maintenance actions, such as purging. Permanent entrapment of air bubbles is therefore prevented or at least mitigated.

A further advantage of the ejection device according to the present invention is that the geometrical tolerances of the nozzle orifice design are less critical and therefore a nozzle orifice geometry according to the present invention is relatively easy to manufacture. The manufacturing requires less processing steps.

In an embodiment, the support may comprise at least one, preferably at least two supporting members located between and attached to an inner wall of the pressure chamber and an outer surface of the obstruction member.

In an embodiment, the pressure chamber comprises a feed-through channel extending towards the nozzle orifice, wherein the obstruction member is arranged in the feed-through channel in a position opposite to the nozzle orifice, wherein the obstruction member comprises a second surface facing a wall of the feed-through channel and wherein the obstruction member is rigidly coupled to said wall of the feed-through channel.

In an embodiment, the feed-through channel, the obstruction member and the support define the hollow shaped liquid passage.

In an embodiment, the feed-through channel comprises the liquid chamber arranged between the hollow liquid passage and the nozzle orifice.

In an embodiment, the obstruction member may have a first width $W_1$ and a first length $L_1$. The feed-through channel may have a second width $W_2$ larger than $W_1$ and a second length $L_2$ smaller than $L_1$. The obstruction member may be arranged such that the hollow shaped liquid passage has a width, preferably substantially equal to $(W_2-W_1)/2$. The obstruction member may be arranged such that the liquid chamber has a third length $L_3$. The sum of the lengths of the liquid chamber and the obstruction member may be smaller than or equal to the length of the feed-through channel, i.e. $L_2+L_3 \leq L_1$. In a particular embodiment, a sum of the length of the liquid chamber and the length of the obstruction member equals the length of the feed-through channel.

In an embodiment, the support may comprise at least one, preferably at least two supporting members located between and attached to an inner wall of the teed-through channel and an outer surface of the obstruction member.

In an embodiment, the at least one supporting member has a fourth length $L_4$ and a fourth width $W_4$. Preferably, the at least one supporting member is arranged with its length direction ($L_4$) substantially in parallel to the length direction of the obstruction member ($L_1$). Preferably, the length of the supporting member is smaller than or equal to the length of the obstruction member ($L_4 \leq L_1$). More preferably, $L_4$ is between $0.5*L_1$ and $L_1$, even more preferably between $0.7*L_1$ and $0.95*L_1$.

Alternatively, the length direction of the supporting members may be arranged at an angle with the length direction of the obstruction member, for example at an angle of between 0° and 60°, in this alternative embodiment, the length of the at least one supporting member may be larger than the length of the obstruction member. Preferably, the length of the at least one supporting member is smaller than or equal to $L_1/\cos\alpha$, wherein α is the angle between the length direction ($L_1$) of the obstruction member and the length direction ($L_2$) of the at least one supporting member.

The width $W_4$ of the at least one supporting member may be substantially equal to the width of the hollow shaped liquid passage, such that the obstruction member is effectively supported. The at least one supporting member provides support to the obstruction member over the entire length of the at least one supporting member.

The inventors have found that the obstruction member is rigidly supported if at least half of the length of the obstruction member is supported. The free movement of the free end of the obstruction member is then significantly reduced, leading to a more reliable jetting process.

In this embodiment, the hollow shaped liquid passage may be segmented, i.e. divided into a number of separate hollow shaped liquid passages connecting the pressure chamber with the liquid chamber. The cross section of the segmented hollow liquid passage may have any desired shape and is defined by the combination of the cross sectional shape of the pressure chamber, at least the cross sectional shape of the part of the pressure chamber wherein the obstruction member is arranged (or in a particular embodiment the feed-through channel), the cross sectional shape of the obstruction member and the cross sectional shape of the at least one supporting member. Depending on the number of supporting members comprised in the support, the cross sectional shape of the hollow shaped liquid passage may be divided into two or more parts. For example, when the supporting structure comprises two supporting members, the liquid passage is divided into two parts, when the supporting structure comprises three supporting members; the liquid passage is divided into three parts, etc.

In an embodiment, the support and the obstruction member may be integral parts of the layer in which the feed-through channel is arranged. An additional advantage of this configuration is that such geometries comprise a single part, which is easier to manufacture when compared to a multi part geometry wherein separate parts (obstruction member, supporting structure and layer comprising feed-through channel) have to be assembled after manufacturing of the separate parts.

In an embodiment, the support may be arranged in the hollow shaped liquid passage.

In an embodiment, the droplet ejection device according to the present invention additionally comprises a structured nozzle inflow mechanism, being arranged between the obstruction member and the nozzle orifice (i.e. in the liquid chamber), wherein the structured nozzle inflow mechanism provides a gradual transition from the hollow shaped liquid passage to the nozzle orifice. The structured nozzle inflow mechanism according to the present embodiment may have a fifth length $L_5$ and a fifth width $W_5$. The structured nozzle inflow mechanism comprises an internal channel structure connecting the hollow shaped liquid passage with the nozzle orifice. The nozzle inflow mechanism may form a barrier for air bubbles preventing the air bubbles moving to undesired positions.

In an embodiment, the width $W_5$ of the structured nozzle inflow mechanism may be equal to or smaller than the width $W_{10}$ of the pressure chamber or, in a particular embodiment, the width $W_2$ of the feed-through channel. Preferably, the width $W_5$ of the structured nozzle inflow mechanism is larger than the width $W_1$ of the obstruction member.

The length $L_5$ of the structured nozzle inflow mechanism is substantially equal to the length $L_3$ of the liquid chamber. Alternatively, the length $L_3$ of the liquid chamber may be defined by the length $L_5$ of the structured nozzle inflow mechanism.

In an embodiment, the structured nozzle inflow mechanism comprises an internal channel structure, in particular a plurality of nozzle inflow holes, connecting the hollow shaped liquid passage with the nozzle orifice. The internal channel structure provides a controlled liquid flow towards the nozzle orifice.

In an embodiment, the structured nozzle inflow mechanism according to the present embodiment may be designed to control the first angle θ between the first direction (i.e. the jetting direction) and the second direction (i.e. the substantially radial direction) as described above.

In an embodiment, the internal channel structure comprises a nozzle inflow hole, preferably a plurality of nozzle inflow holes, the nozzle inflow hole having an axial axis, the nozzle inflow hole being arranged such that the axial axis is at an angle ϕ with a radial axis of the nozzle orifice, the angle ϕ being up to 80°.

According to this embodiment, the structured nozzle inflow mechanism may he designed to control a second angle, which is substantially equal to ϕ between a third direction (i.e. nozzle inflow direction) and the second substantially radial direction (as defined above). The angle ϕ is preferably between 5° and 70°, more preferably between 10° and 60°. The direction of the nozzle inflow hole, in particular of the plurality of nozzle inflow holes according to the present embodiment may, in operation, result in a circular liquid flow around the axial axis of the nozzle orifice and towards the nozzle orifice, which is advantageous regarding system tolerance with respect to jet direction.

In an embodiment, the droplet ejection device further comprises a flow passage in fluid connection with the pressure chamber and a circulation system for circulating the liquid through the pressure chamber. Such a droplet ejection device is a through-flow ejection device.

This has the advantage that the flow passage, the pressure chamber (in a particular embodiment comprising the feed-through channel) are scavenged with the liquid so that any possible contaminants that may be contained in the liquid are prevented from being deposited on the walls of the flow passage, the pressure chamber, the feed-through channel or the nozzle orifice and are removed with the flow of the liquid. Likewise, the flow of liquid helps to remove air bubbles that could compromise the generation of the pressure wave and the ejection of the droplet. Moreover, the constant flow of liquid reduces the risk that the nozzle orifice dries out.

In an embodiment, the obstruction member is arranged such as to define at least two separate hollow shaped liquid passages. In this embodiment, the through-flow principle may be applied by generating a liquid flow from the pressure chamber towards the nozzle orifice through a first hollow shaped liquid passage while a return flow from the nozzle orifice to the pressure chamber is generated through a second hollow shaped liquid passage. The droplet ejection device may be designed such that the flow passage that is in fluid connection with the pressure chamber and the circulation system, in operation, provides a liquid flow to the first hollow liquid passage.

Manufacturing Process

Manufacturing of a droplet ejection device according to the present invention comprising a feed-through channel, an obstruction member, a nozzle orifice and optionally a structured nozzle inflow mechanism can be easily realized with standard dry etching processes in separate wafers and bonding these wafers afterwards. For instance, the feed-through channel, the obstruction member and structured nozzle inflow mechanism can be etched in a first wafer (etching from both sides of this wafer) and the nozzle orifice can be etched in a second wafer. The first and the second wafers can be attached to each other with a wafer bonding process.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF TILE DRAWINGS

The present invention will become more fully understood from the detailed description given hereinbelow and the accompanying drawings which are given by way of illustration only, and thus are not limitative of the present invention, and wherein.

Figure 6A:
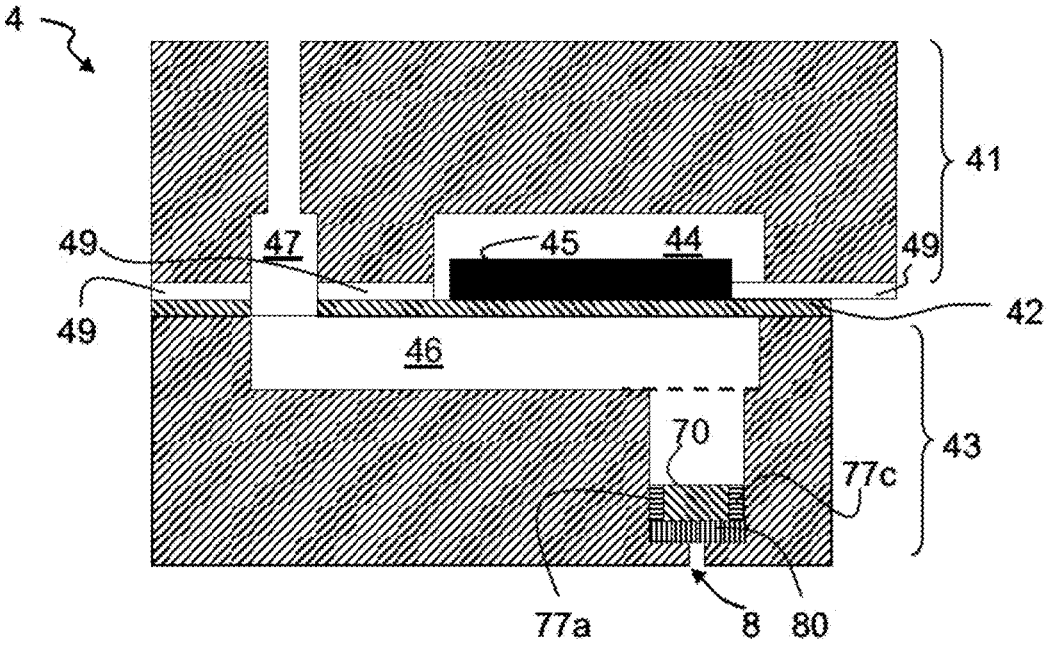
Figure 6B:
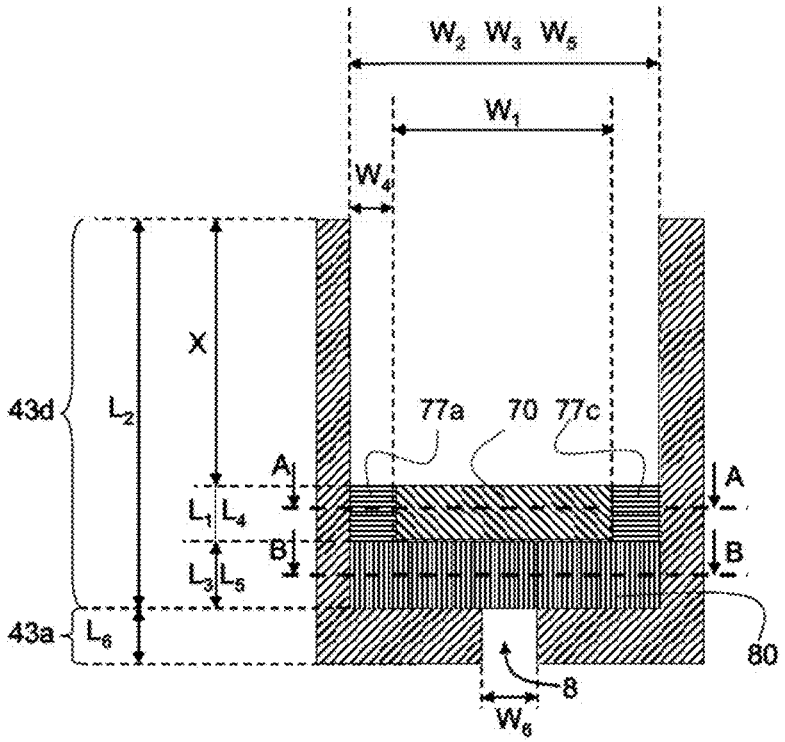
Figure 6C:
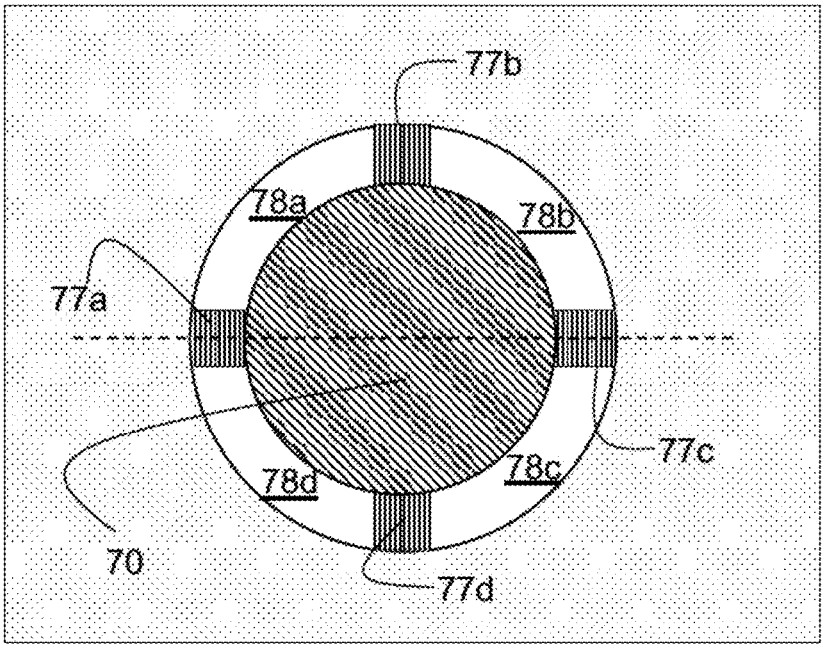

FIGS. 5A-5D schematically show the effect of the obstruction member according to the present invention on the movement of the meniscus (liquid-air interface) after a droplet has been expelled;

FIG. 6A is a schematic cross-sectional view of a droplet ejection device comprising an obstruction member, a support and structured nozzle inflow mechanism according to an embodiment of the present invention;

FIG. 6B is a detail of the cross-sectional view of the droplet ejection device of FIG. 6A;

FIG. 6C is a cross sectional view along line A-A as shown in FIG. 6B

Figure 5A:
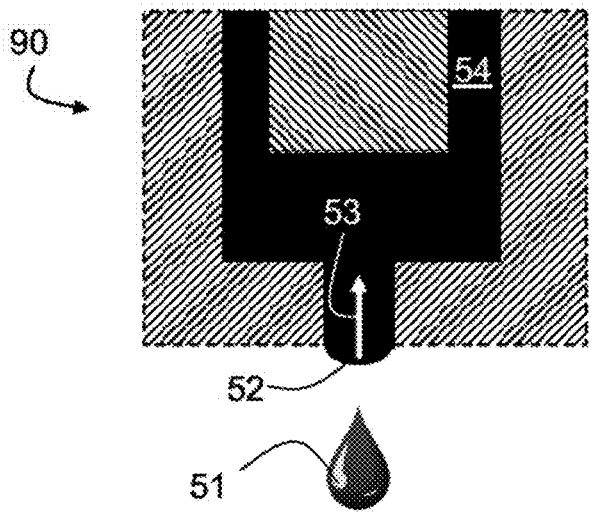
Figure 5B:
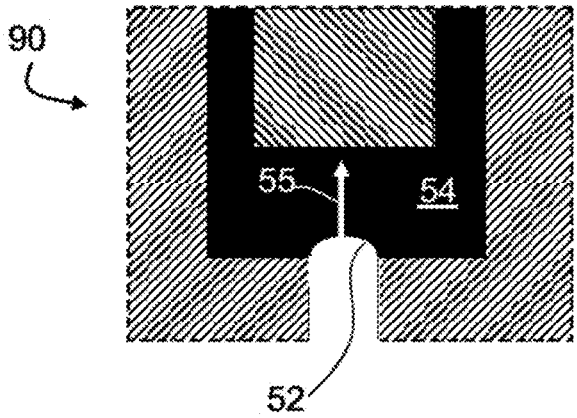
Figure 5C:
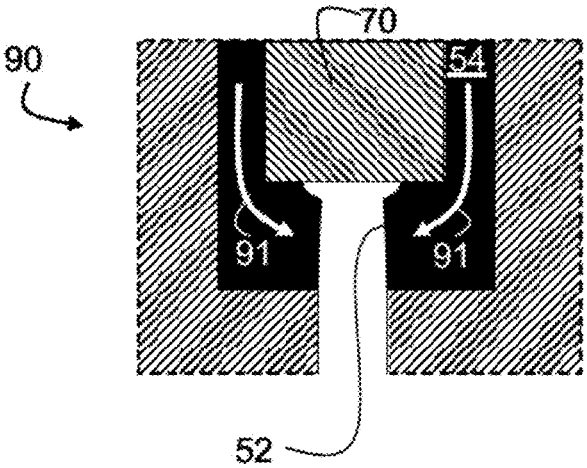
Figure 6D:
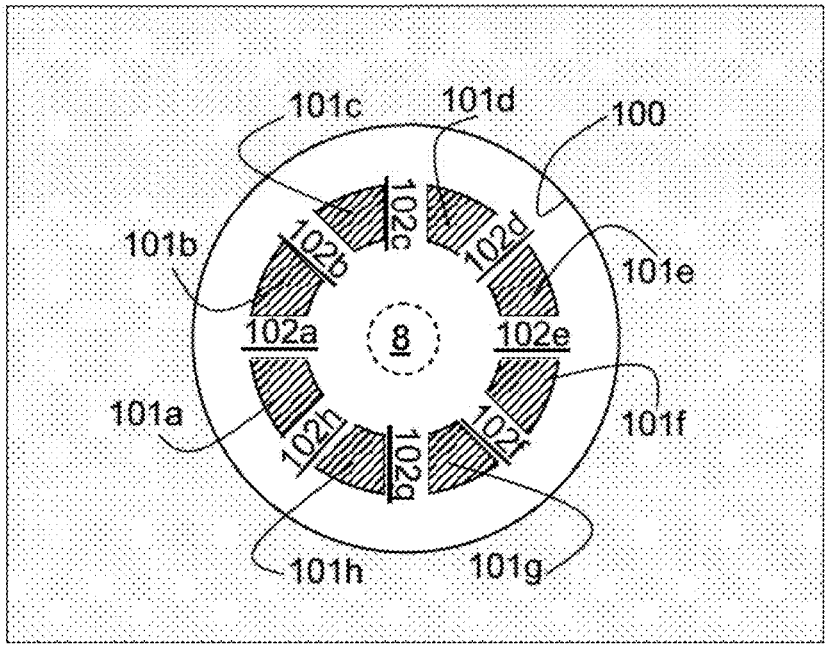
Figure 6E:
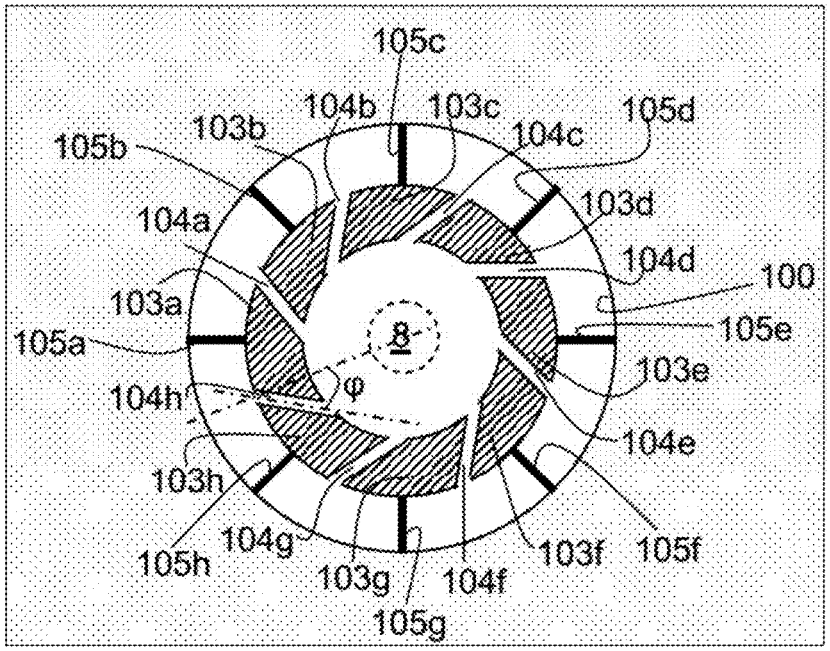
Figure 6F:
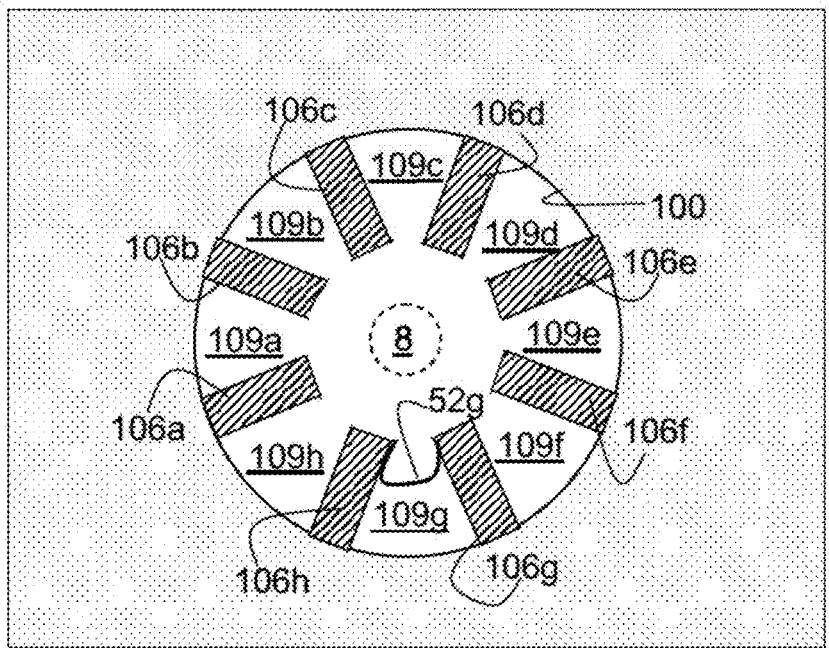
Figure 7:
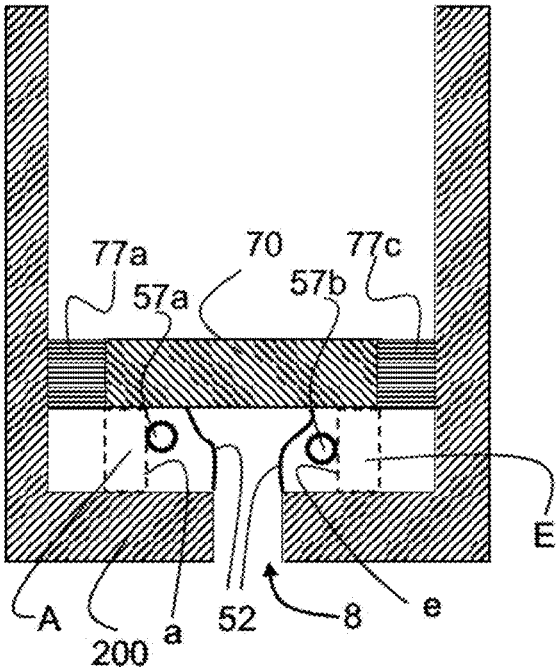
Figure 8A:
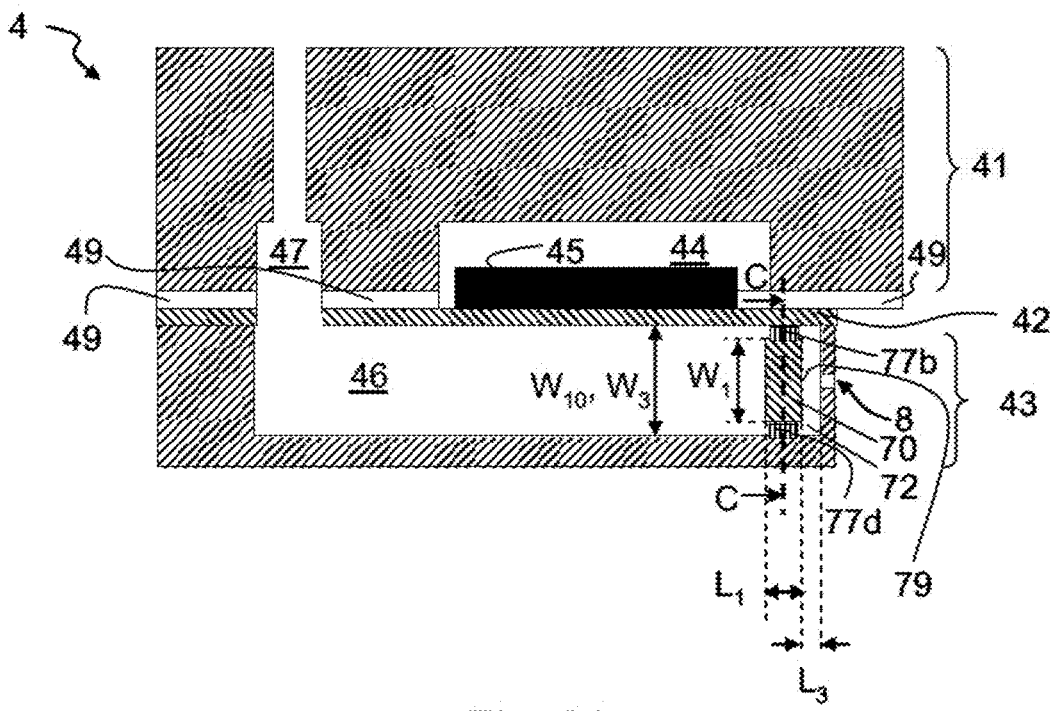
Figure 8B:
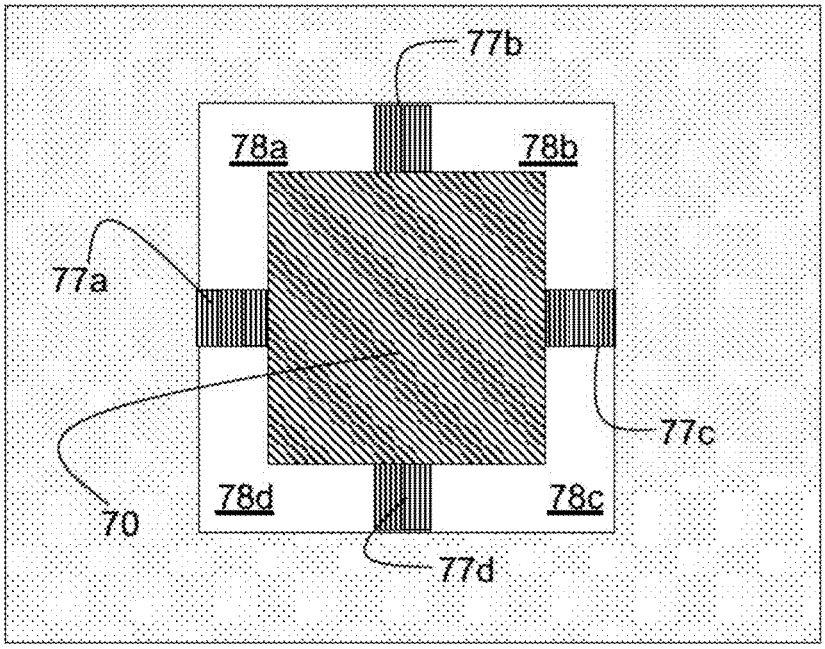

FIG. 6D is a cross sectional view along line B-B as shown in FIG. 5B of an example of the structured nozzle inflow mechanism according to an embodiment of the present invention;

FIG. 6E is a cross sectional view along line B-B as shown in FIG. 5B of an example of the structured nozzle inflow mechanism according to an embodiment of the present invention;

FIG. 6F is a cross sectional view along line B-B as shown in FIG. 5B of an example of the structured nozzle inflow mechanism according to an embodiment of the present invention;

FIG. 7 schematically shows the effect of the obstruction member and the structured nozzle inflow mechanism according to the present invention on the movement of the meniscus (liquid-air interface) after a droplet has been expelled;

FIG. 8A is a schematic cross-sectional view of a droplet ejection device comprising an obstruction member and support according to an embodiment of the present invention;

FIG. 8B is a cross sectional view along line C-C as shown in FIG. 8A; and

Figure 8C:
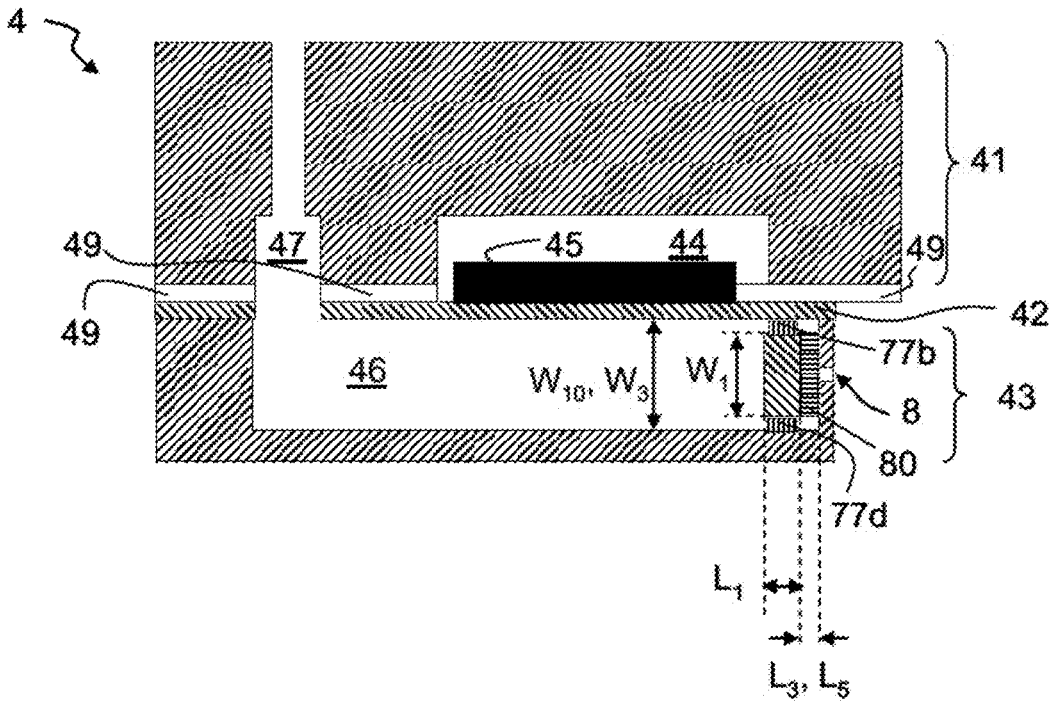

FIG. 8C is a schematic cross-sectional view of a droplet ejection device as shown in FIG. 8A, further comprising a structured nozzle inflow mechanism as exemplified in FIGS. 6D, 6E and 6F.

DETAILED DESCRIPTION OF THE PREFERRED EMBODIMENTS

The present invention will now be described with reference to the accompanying drawings, wherein the same reference numerals have been used to identify the same or similar elements throughout the several views.

Figure 1:
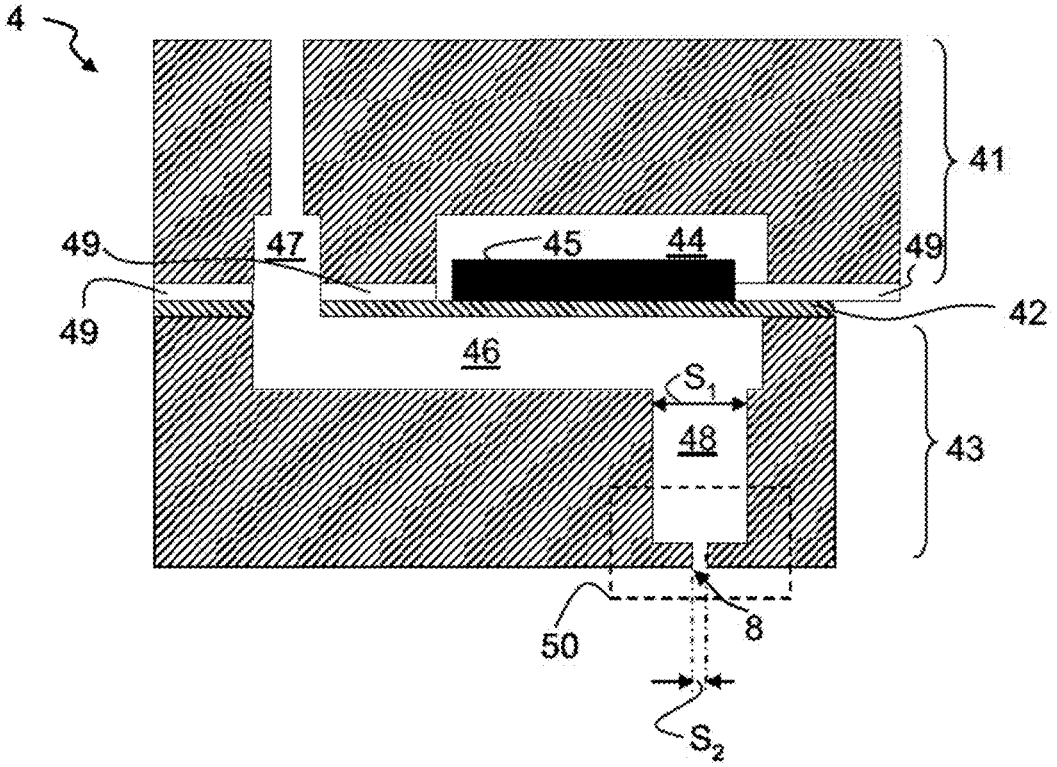
FIG. 1 is a schematic cross-sectional view of a droplet ejection device having a straight nozzle configuration according to the background art.

FIG. 1 is a schematic cross-sectional view of a droplet ejection device 4 having a straight nozzle configuration, i.e. a straight nozzle orifice 8 connected to a straight feed-through channel 48. The droplet ejection device 4 is assembled from three layers of material: a first layer 41 having arranged therein a fluid inlet channel 47 and an actuator cavity 44; a second layer 42 having arranged thereon a piezo actuator 45 and provided with a through hole to extend the inlet channel 47; and a third layer 43 having arranged therein a pressure chamber 46, a feed-through channel 48 having a first dimension $S_1$ and a nozzle orifice 8 having a second dimension $S_2$ being smaller than the first dimension $S_1$. FIG. 1 further shows a bonding layer 49, which provides bonding of the first layer 41 and the second layer 42. Similarly the second layer 42 and the third layer 43 may be bonded to each other (not shown).

The droplet ejection device 4 is configured to receive a fluid such as an ink composition through the inlet channel 47. The fluid fills the pressure chamber 46. Upon supply of a suitable drive signal to the piezo actuator 45, a pressure response is generated in the pressure chamber 46 resulting in a droplet of fluid being expelled through the nozzle orifice 8.

Figure 2A:
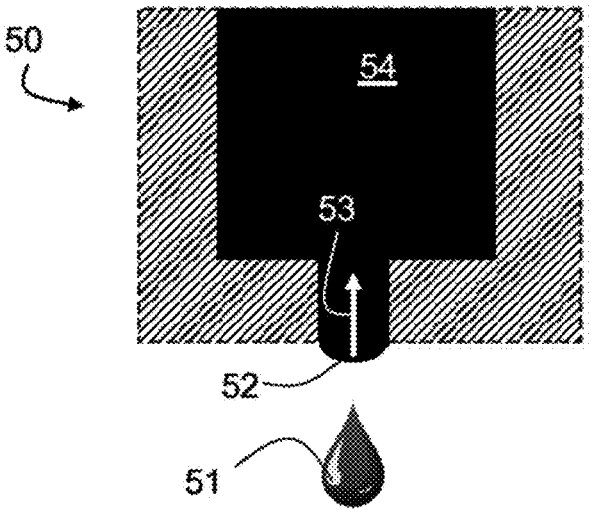
FIGS. 2A-2D are schematic representations of air bubble formation in a droplet ejection device as shown in FIG. 1.
Figure 2B:
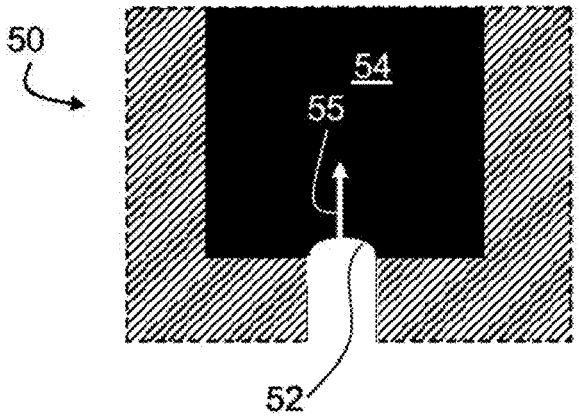
Figure 2C:
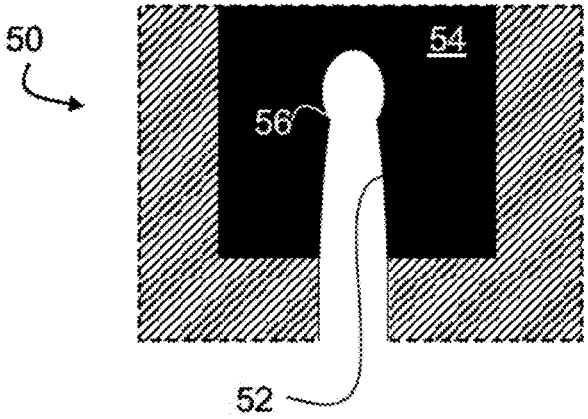
Figure 2D:
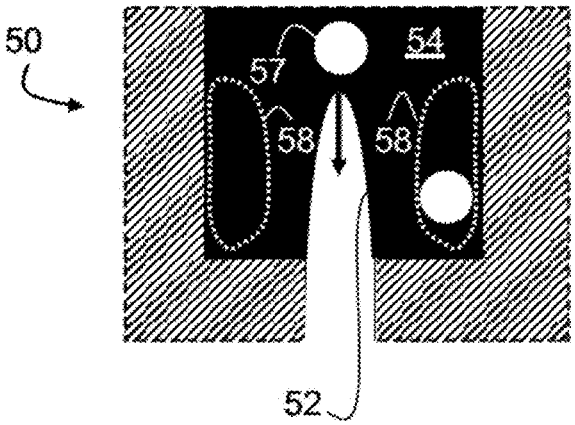

FIGS. 2A-2D are schematic representations of air bubble formation. FIG. 2A shows an enlarged view of a part of the feed-through channel 48 and the nozzle orifice 8, as indicated with interrupted line 50 in FIG. 1. FIG. 2A represents a state of the droplet ejection device just after expelling a droplet 51 of a liquid, e.g. an ink droplet. FIG. 2A further shows a liquid-air interface 52, also termed meniscus that tends to move into the nozzle, indicated with arrow 53, as a result of a residual pressure wave that propagates through the liquid 54 present in the droplet ejection device. FIG. 2B shows the liquid-air interface 52 moving into the feed-through channel, indicated with arrow 55. The nozzle orifice is filled with air in this stage. FIG. 2C shows a necking 56 of the air that has entered the feed-through channel via the nozzle orifice. This necking occurs because of the natural tendency of the air-liquid system to minimize its surface energy, thus minimizing the liquid-air surface area, resulting in substantially spherical air bubbles 57 as shown in FIG. 2D. The size of the formed air bubbles is determined by the surface tension of the air-liquid interface and the pressure inside the bubble at equilibrium.

The ejection device as shown in FIG. 1 and a detail thereof in FIG. 2A show a discrete transition between the feed-through channel 48 and the nozzle orifice 8, which may in operation of the droplet ejection device result in dead volumes as indicated with the dotted lines 58 in FIG. 2D.

A dead volume in the context of the present invention should be construed as a part of the volume of the interior of the droplet ejection device containing the ejection liquid, in which part the refresh rate with the ejection liquid is relatively low compared to other parts of the volume of the interior of the droplet ejection device. In other words, the residence time of the ejection liquid in the above defined dead volume is significantly higher than in other parts of the volume of the interior of the droplet ejection device.

Once an air bubble has been formed (see FIG. 2D), it may end up in such a dead volume in the feed-through channel. If an air bubble becomes entrapped in a dead volume 58, it is difficult to remove it, even by maintenance actions such as purging.

Figure 3A:
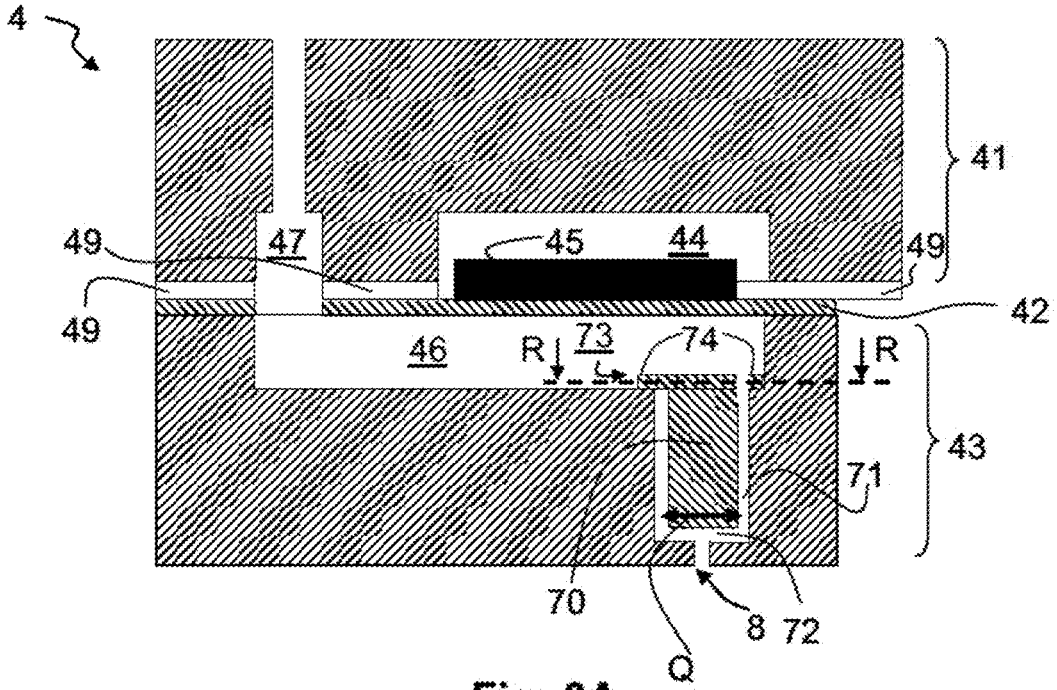
FIG. 3A is a schematic cross-sectional view of a droplet ejection device comprising an obstruction member according to the background art.

FIG. 3A is a schematic cross-sectional view of a droplet ejection device comprising an obstruction member according to the background art. Besides all the features already discussed above (FIG. 1) the ejection device of FIG. 3A shows an obstruction member 70 arranged in the feed-through channel and defining a hollow shaped liquid passage 71 and a liquid chamber 72. FIG. 3A further shows that obstruction member 70 is supported by supporting member 73. Supporting member 73 provides a ledge 74 (also shown in FIG. 3B) having a larger width than the width of the feed-through channel, such that the obstruction member 70 is supported on a part of a wall of the pressure chamber 46. The free end of the obstruction member can freely move in the lateral direction as indicated with double arrow Q. This free movement may disturb the jetting process and enhance breaking up of sucked in air into small air bubbles, which are difficult to remove by standard maintenance actions such as purging.

Figure 3B:
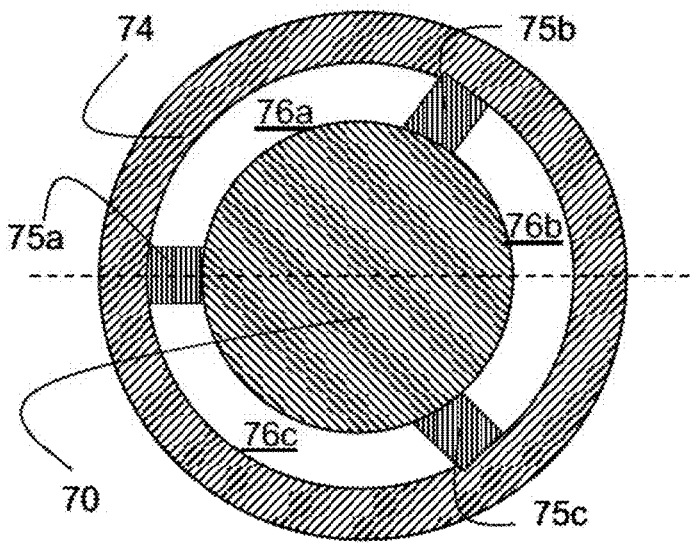
FIG. 3B is a schematic cross-sectional view along line R-R of the obstruction member and support present in the droplet ejection device shown in FIG. 3A.

FIG. 3B is a schematic cross-sectional view along line R-R of the obstruction member and support present in the droplet ejection device shown in FIG. 3A. FIG. 3B further shows that the obstruction member 70 is connected to ledge 74 via three connecting elements 75*a*, 75*b* and 75*c*. The connecting elements are arranged at substantial equal distance from one another around the perimeter of the obstruction member 70. The obstruction member 70, ledge 74 and connecting elements 75*a*, 75*b* and 75*c* define three hollow ring segments 76*a*, 76*b* and 76*c*, which provide liquid passages from the pressure chamber 46 to the hollow shaped liquid passage 71, which is a hollow ring shaped liquid passage.

Figure 4A:
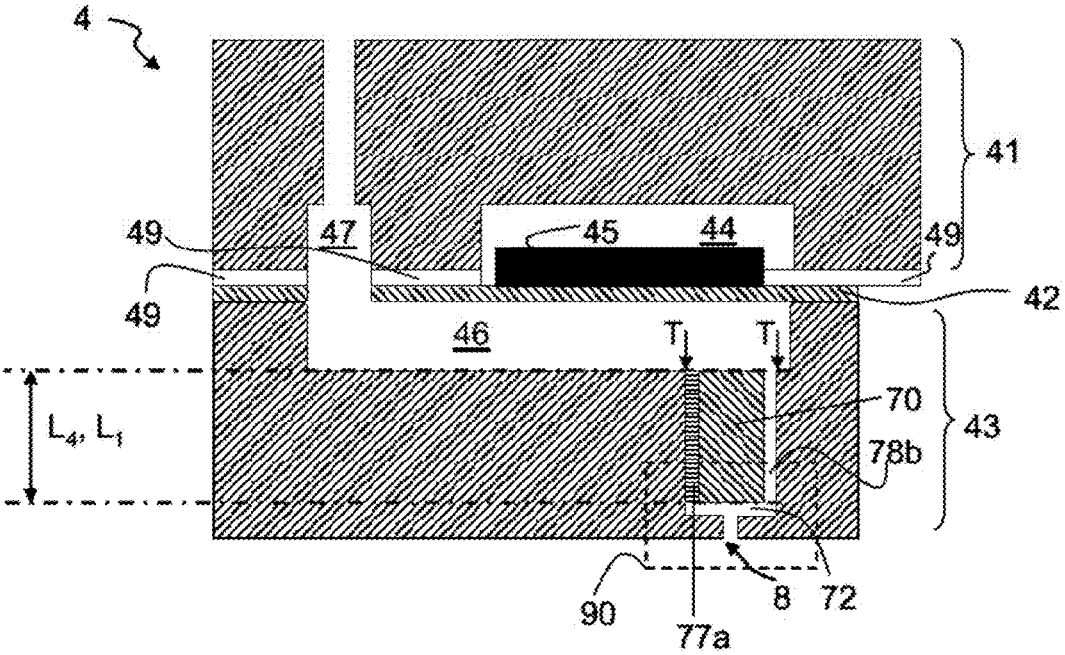
FIG. 4A is a schematic cross-sectional view of a droplet ejection device comprising an obstruction member and support according to an embodiment of the present invention.

FIG. 4A is a schematic cross-sectional view of a droplet ejection device comprising an obstruction member 70 and support according to an embodiment of the present invention. Besides all the features already discussed above (FIG. 1 and FIGS. 3A and 3B) the ejection device of FIG. 4A shows a supporting member 77*a* having a length $L_4$ being substantially equal to the length $L_1$ of the obstruction member 70. In this embodiment, the obstruction member 70 is supported by supporting member 77*a* over the full length of the obstruction member 70. The obstruction member 70 does not have a freely movable end. The obstruction member 70 is hence rigidly supported in the feed-through channel 48.

Figure 4B:
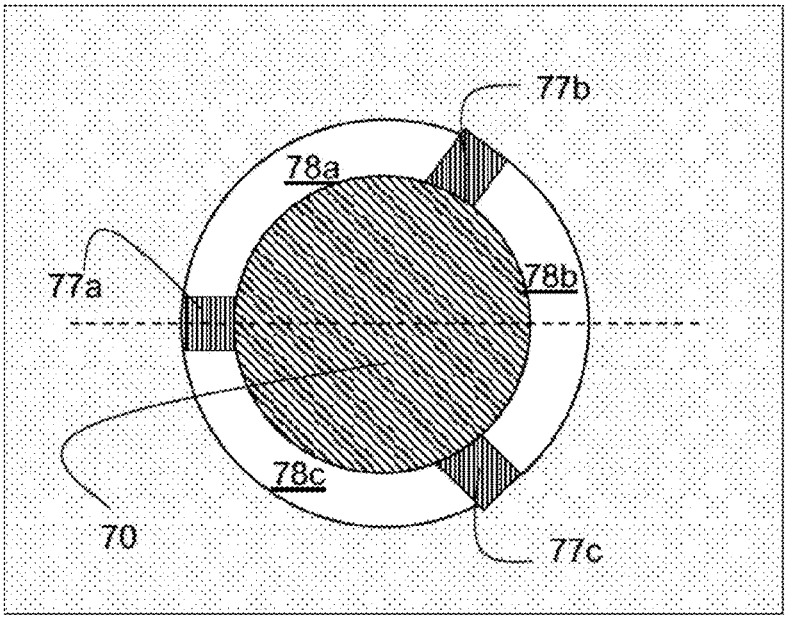
FIG. 4B is a schematic top view along line T-T of the obstruction member and support shown in FIG. 4A.

FIG. 4B is a schematic top view along line T-T of the obstruction member 70 and support shown in FIG. 4A. FIG. 4A shows that the obstruction member 70 is supported by three supporting members 77*a*, 77*b* and 77*c*, which are arranged at substantial equal distance from one another around the perimeter of the obstruction member 70. The three supporting members 77*a*, 77*b* and 77*c* substantially have the same lengths, which are substantially equal to the length of the obstruction member 70 as shown for supporting member 77*a* in FIG. 4A. The hollow shaped liquid passage connecting the pressure chamber 46 with the liquid chamber 72 comprises three hollow ring segments 78*a*, 78*b* (see also FIG. 4A) and 78*c*. The hollow ring segments extend in the length direction of the supporting members 77*a*, 77*b* and 77*c* and have a length substantially equal to the length of the supporting members 77*a*, 77*b* and 77*c*.

Figure 4C:
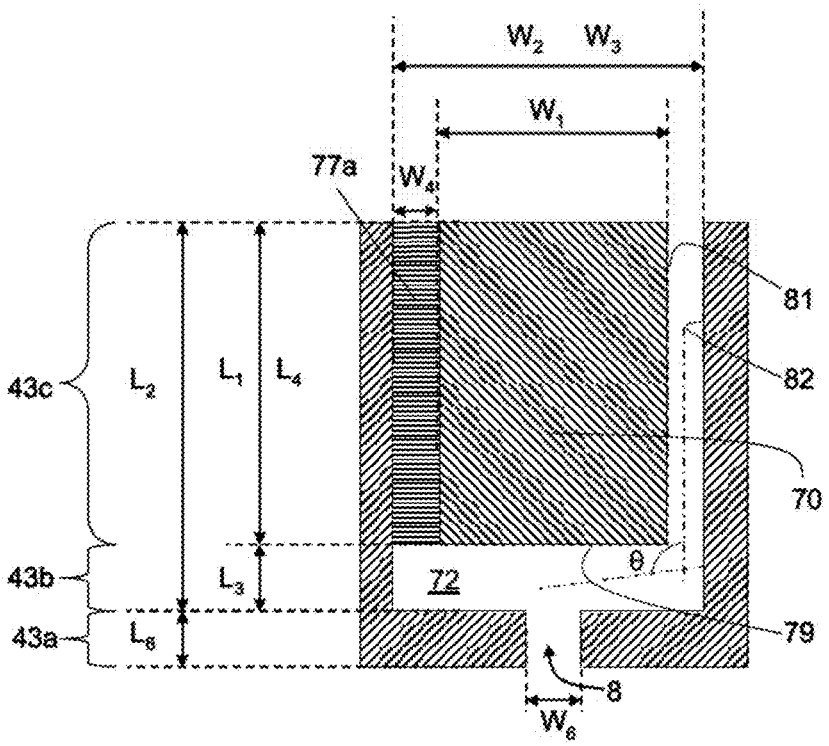
FIG. 4C is a detail of the cross-sectional view of the droplet ejection device of FIG. 4A.

FIG. 4C shows a detail of the cross-sectional view of the droplet ejection device of FIG. 4A. FIG. 4C shows that the obstruction member 70 may have a length $L_1$, a width $W_1$ a first surface 79 and a second surface 81. The feed-through channel 48 (see FIG. 1) may have a length $L_2$, a width $W_2$ and an (inner) wall 82. The obstruction member 70 is arranged in the feed-through channel 48 such that the first surface 79 faces the nozzle orifice 8 and the second surface 81 faces the wall 82 of the feed-through channel 48. A liquid chamber 72 is defined by the first surface 79 of the obstruction member and the transition between the feed-through channel 48 and the nozzle orifice 8. The liquid chamber has a length $L_3$ which equals $L_2-L_1$ and a width $W_3$ which in this embodiment is substantially equal to the width $W_2$ of the feed-through channel 48. The supporting members 77*a*, 77*b* and 77*c* (the latter two are not shown in FIG. 4C) have a length $L_4$ substantially equal to the length $L_1$ of the obstruction member 70 and a width $W_4$ which is substantially equal to $(W_2-W_1)/2$. The obstruction member 70 in the present embodiment is rigidly supported. In this configuration, in operation, a liquid is transported through the hollow ring segments 78*a*, 78*b* and 78*c* (see FIGS. 4A and 4B) to the liquid chamber 72 and towards the nozzle orifice 8. The direction of the flow changes over a first angle θ.

The nozzle orifice 8 has a length $L_6$ and a width $W_6$.

Typically, the feed-through channel 48 has a width of between 60 μm and 180 μm, preferably between 80 μm and 160 μm, more preferably between 100 μm and 140 μm, for example around 120 μm. The length of the feed-through channel is typically between 250 μm and 400 μm, preferably between 300 μm and 350 μm, more preferably around 330 μm.

The obstruction member typically has a width of between 30 μm and 140 μm, preferably between 60 μm and 120 μm, more preferably between 75 μm and 105 μm, for example around 90 μm. The length of the obstruction member is preferably between 235 μm and 385 μm, preferably between 285 μm and 335 μm, more preferably around 315 μm. The length of the liquid chamber is preferably between 5 μm and 30 μm, more preferably between 10 μm and 20 μm, for example around 15 μm. The nozzle orifice has a diameter of between 10 μm and 50 μm, preferably between 15 μm and 40 μm, for example around 30 μm. The length of the nozzle orifice may he between 5 μm and 30 μm, preferably between 7 μm and 15 μm, for example around 10 μm.

Figure 4D:
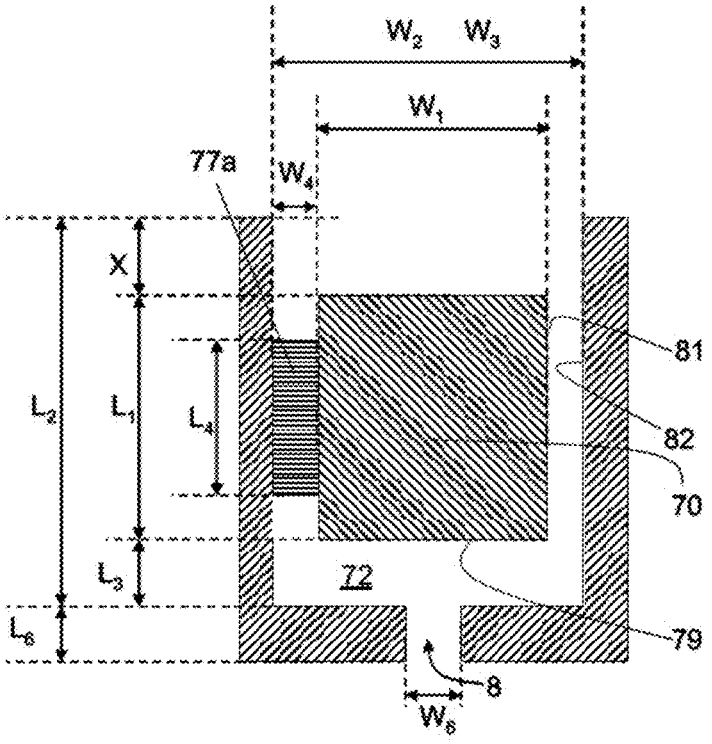
FIG. 4D is a detail of the cross-sectional view of the droplet ejection device of FIG. 4A.

In another embodiment, shown in FIG. 4D, the obstruction member 70 may have a length $L_1$, and the feed-through channel 48 may have a length $L_2$. The first end (i.e. the top end in FIG. 4D) of the obstruction member 70 is arranged at a distance X from the transition between the pressure chamber 46 and the feed-through channel 48. A liquid chamber 72 is defined by a second end (i.e. bottom end in FIG. 4D) and the transition between the feed-through channel 48 and the nozzle orifice 8. The liquid chamber 72 has a length $L_3$, which equals $L_2-L_1-X$. The supporting members 77*a*, 77*b* and 77*c* (the latter two are not shown in FIG. 4D) have a length $L_4$, which is about 70% of the length of the obstruction member $L_1$ ($L_4=0.7*L_1$). The obstruction member 70 in the present embodiment is rigidly supported.

FIG. 5 schematically shows the effect of the obstruction member according to the present invention on the movement of the meniscus (liquid-air interface) after a droplet has been expelled. FIG. 5A shows an enlarged view of a part of the feed-through channel 48 and the nozzle orifice 8, as indicated with interrupted line 90 in FIG. 4A. FIG. 5A represents a state of the droplet ejection device just after expelling a droplet 51 of a liquid, e.g. an ink droplet. FIG. 5A further shows a liquid-air interface 52, also termed meniscus that tends to move into the nozzle, indicated with arrow 53, as a result of a residual pressure wave that propagates through the liquid 54 present in the droplet ejection device. FIG. 5B shows the liquid-air interface 52 moving into the liquid chamber, indicated with arrow 55. The nozzle orifice 8 is filled with air in this stage. FIG. 5C shows that the liquid-air interface reaches the obstruction member 70 which acts as a brake and prevents air bubble formation. FIG. 5C also shows that during operation, the liquid is forced to flow around the obstruction member 70, as indicated with arrows 91, resulting in a reduction of dead volumes. The liquid volume present in the feed-through channel 48 is reduced; hence at a given volume flow rate of the liquid, the residence time of the fluid present in the hollow shaped liquid passage and the liquid chamber is significantly reduced. Air entrapment may be avoided or at least reduced.

Figure 5D:
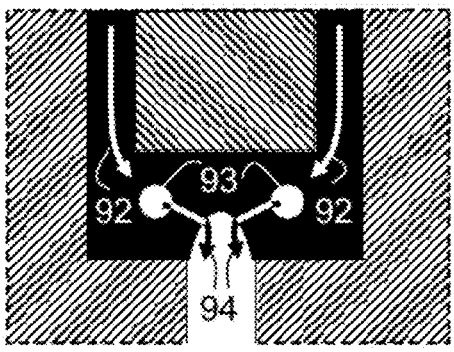

In the rare event that air bubbles 93 are formed, they can be easily removed by the liquid flow (e.g. ink flow) around the obstruction member 70 towards the nozzle orifice 8 during jetting or by simple maintenance actions (e.g. purging), as indicated with arrows 92 and 94 in FIG. 5D. Permanent entrapment of air bubbles is therefore prevented or at least mitigated.

FIG. 6A shows an obstruction member 70, supporting members 77*a* and 77*c* and a structured nozzle inflow mechanism 80, arranged between the obstruction member 70 and the nozzle orifice 8, i.e. in the liquid chamber.

FIG. 6B shows a detail of the cross-sectional view of the droplet ejection device of FIG. 6A. Obstruction member 70 has a length $L_1$ and a width $W_1$. The structured nozzle inflow mechanism 80 has a width $W_5$ and a length $L_5$. In the present embodiment, the width of the structured nozzle inflow mechanism 80 is substantially equal to the width of the feed-through channel 48 ($W_5 \approx W_2$). Alternatively, the width of the structured nozzle inflow mechanism 80 may be smaller than the width of the feed-through channel 48. Preferably, the width of the structured nozzle inflow mechanism 80 is equal to or larger than the width of the obstruction member 70 ($W_5 \geq W_1$). FIG. 6B further shows supporting elements 77*a* and 77*c* having a length $L_4$ and a width $W_4$. By controlling the stiffness of the obstruction member, the meniscus movement can be damped. The length of the obstruction member according to the present embodiment typically lies in the range of 1 to 50 μm.

FIG. 6C shows a cross sectional view along line A-A as shown in FIG. 6B. FIG. 6C shows an obstruction member 70, and four supporting members 77*a*, 77*b*, 77*c*, 77*d* arranged at substantially equal distances from one another around the perimeter of the obstruction member 70. The feed-through channel 48, the obstruction member 70 and the supporting members 77*a*, 77*b*, 77*c*, 77*d* define four hollow shaped liquid passages 78*a*, 78*b*, 78*c* and 78*d* connecting the pressure chamber 46 with the structured nozzle inflow mechanism 80.

FIG. 6D shows a cross sectional view along line B-B as shown in FIG. 6B of an example of the structured nozzle inflow mechanism 80 according to an embodiment of the present invention. FIG. 6D shows that the structured nozzle inflow mechanism 80 comprises a wall 100 and eight structural elements 101*a-h* defining eight nozzle inflow holes 102*a-h*. The nozzle inflow holes are arranged such that a substantially radially directed liquid flow (in the direction of the nozzle orifice 8 of which a projection is shown in FIG. 6D) may be obtained in operation, i.e. the angle ϕ as defined above and shown in FIG. 6D is substantially 0°.

FIG. 6E shows across sectional view along line B-B as shown in FIG. 6B of an example of the structured nozzle inflow mechanism 80 according to an embodiment of the present invention. FIG. 6E shows that the structured nozzle inflow mechanism 80 comprises a wall 100 and eight structural elements 103*a-h* defining eight nozzle inflow holes 104*a-h*. The nozzle inflow holes are arranged such that, in operation, the liquid flow through the nozzle inflow holes is at an angle ϕ with the radial direction as shown for nozzle inflow hole 104*h* in FIG. 6E.

Changing the direction of the inflow holes according to this embodiment may result in a circular liquid flow around the nozzle orifice axis, which leads to a more tolerant system with respect to jet direction (i.e. a more consistent jet angle).

FIG. 6E further shows eight stiffening members 105*a-h*, which provide stiffness to the nozzle layer 200 (see FIG. 7), such that cracking of the thin nozzle layer 200 may be prevented.

FIG. 6F shows a cross sectional view along line B-B as shown in FIG. 6B of an example of the structured nozzle inflow mechanism 80 according to an embodiment of the present invention. FIG. 6F shows that the structured nozzle inflow mechanism 80 comprises a wall 100 and eight structural elements 106*a-h* attached to the wall 100 and defining eight nozzle inflow holes 109*a-h*. The nozzle inflow holes are arranged such that a substantially radially directed liquid flow may be obtained in operation, i.e. the angle ϕ as defined above and shown in FIG. 6D may be substantially 0°.

The structured nozzle inflow mechanism 80 according to the present invention may be filled with the liquid meniscus (i.e. air-liquid interface) during the drawback of the meniscus, preventing an uncontrolled breaking-up process of the meniscus leading to air bubbles (see meniscus 52*g* in inflow hole 109*g* in FIG. 6F; similar menisci may be formed in other inflow holes as shown in FIGS. 6D, 6E and 6F).

FIG. 7 schematically shows the effect on the movement of the meniscus (liquid-air interface) after a droplet has been expelled of the obstruction member 70 and the structured nozzle inflow mechanism 80 according to the embodiments as shown in FIGS. 6D-6F.

FIG. 7 shows that the liquid-air interface 52 reaches the obstruction member 70, which acts as a brake and prevents air bubble formation, as explained above and also shown in FIG. 5C. FIG. 7 further shows obstruction member 70; supporting members 77*a* and 77*c;* nozzle layer 200 comprising nozzle 8; a projection of structural elements A (which corresponds to 101*a*, 103*a* and 106*a* of FIGS. 6D, 6E and 6F, respectively) and E (which corresponds to 101*e*, 103*e* and 106*e* of FIGS. 6D, 6E and 6F, respectively); and an end of inflow holes, indicated with a and e, corresponding to the ends nearest to the nozzle orifice 8 of the inflow holes 102*a*, 102*e*, 104*a*, 104*e*, 109*a* and 109*e* of FIGS. 6D, 6E and 6F, respectively. The structural elements act as a barrier for air bubbles. Air bubbles 57*a* and 57*b* will not pass this barrier and hence will not end up in undesired positions in the jetting device. During operation (i.e. jetting) or during simple maintenance actions (e.g. purging) formed air bubbles can be easily removed.

With the structured nozzle inflow mechanism 80 as shown in any of the FIGS. 6D-6F, the meniscus draw back will be limited, avoiding air bubble entrapment. The length of the nozzle inflow mechanism $L_5$ may be typically between $W_6$ and $5*W_6$, wherein $W_6$ represents the width of the nozzle orifice 8 (in the present example equal to the diameter of the nozzle orifice).

The structured nozzle inflow mechanism 80 can stop air bubble transport by introduction of nozzle inflow holes as discussed above and shown in FIGS. 6D-6F. A typical distance between nozzle orifice 8 and the nozzle inflow holes is $\frac{1}{2}*W_6$ to $5*W_6$, wherein $W_6$ has the above stated meaning. Preferably, the sum of ratios of the perfused surface of the nozzle inflow holes and the nozzle inflow lengths is larger than or equal to the ratio of the perfused nozzle orifice surface and the nozzle length.

For example, for a circular nozzle orifice having a diameter of 30 μm and a length of 10 μm, this can be realized with 8 holes of 20 μm×20 μm and a length of 40 μm (8*20 μm*20 μm/40 μm=80 μm; $\pi/4*(30\ \mu m)^2/10\ \mu m \approx 70.7\ \mu m$; 80 μm>70.7 μm).

FIG. 8A is a schematic cross-sectional view of a droplet ejection device comprising an obstruction member 70 and a support comprising supporting elements 77*b* and 77*d*. The obstruction member 70 has a width $W_1$ and a length $L_1$ and is arranged in the pressure chamber 46, which has a width $W_{10}$. The obstruction member 70 is arranged in a position opposite the nozzle orifice 8. A first surface 79 of the obstruction member 70 faces the nozzle orifice 8. The pressure chamber comprises a liquid chamber 72 arranged between the first surface 79 of the obstruction member 70 and the nozzle orifice 8. The liquid chamber 72 has a length $L_3$ and a width $W_3$, which is substantially equal to the width $W_{10}$ of the pressure chamber 46. The working of the present embodiment concerning preventing air bubbles from entering the pressure chamber and the reduction of dead volumes is the similar as described above. All other reference numbers refer to similar items as discussed above.

FIG. 8B is a cross-sectional view along line C-C as shown in FIG. 8A. FIG. 8A shows an obstruction member 70, which in the present embodiment has a substantially square cross sectional surface area, and four supporting members 77*a*, 77*b*, 77*c*, 77*d* arranged at substantially equal distances from one another around the square perimeter of the obstruction member 70. The pressure chamber, the obstruction member 70 and the supporting members 77*a*, 77*b*, 77*c*, 77*d* define four hollow shaped liquid passages 78*a*, 78*b*, 78*c* and 78*d* connecting the pressure chamber 46 with the liquid chamber 72.

FIG. 8C is a schematic cross-sectional view of a droplet ejection device as shown in FIG. 8A, further comprising a structured nozzle inflow mechanism 80, having a length $L_5$ substantially equal to the length $L_3$ of the liquid chamber 72. The structured nozzle inflow mechanism 80 may be similar to the structured nozzle inflow mechanism 80 as shown in FIGS. 6D, 6E of 6F. The wall 100 of the structured nozzle inflow mechanism 80 may have a differently shaped perimeter, for example a square perimeter, depending on the shape of the cross sectional area of the pressure chamber 46 in a direction of line C-C in FIG. 8A. The stiffening members 105*a-h* (FIG. 6E) or the structural elements 106*a-h* (FIG. 6F) are arranged such that they are in connection with wall 100, independent of the shape of the perimeter of wall 100. The structured nozzle inflow mechanism 80 has the same function as described above.

A nozzle orifice with an obstruction member as shown in FIG. 4A and in detail in FIG. 4C or FIG. 4D can be manufactured by lithography starting with a so-called 'double SOI-wafer', comprising a handle and two device layers. The first device layer has a thickness of $L_6$ and is used to form the nozzle orifice 8 and corresponds to layer 43*a* shown in FIG. 4C, the second device layer has a thickness of $L_3$ and will eventually form the volume bound by dimensions $L_3$ and $W_3$, shown as layer 43*b* in FIG. 4C. The handle of the SOI-wafer is used to form the geometry of the obstruction member 70 and the support, enabling the obstruction member 70, the support and the surroundings to be formed as one integral part, which results in layer 43*c*.

To manufacture the geometry that is shown in FIG. 6A, and in more detail in FIG. 6B, a SOI-wafer comprising a device layer and a handle (not shown) may be used. The device layer of the SOI-wafer is used to form the nozzle orifice layer 43*a* (FIG. 6B) and can be bonded with a second wafer, in which all other geometry (feed-through channel 48, obstruction member 70, supporting members 77*a*, 77*b*, 77*c* and the structured nozzle inflow mechanism 80), may be patterned (layer 43*d* in FIG. 6B). Optionally, the pressure chamber 46 is also formed in the second wafer. The handle of the SOI wafer then extends from the exit of the nozzle orifice 8 in opposite direction from the feed-through channel 48. After wafer bonding, the handle of the SOI-wafer is removed and the geometry is complete.

Detailed embodiments of the present invention are disclosed herein; however, it is to be understood that the disclosed embodiments are merely exemplary of the invention, which can be embodied in various forms. In particular, the obstruction member, the support and the structured nozzle inflow mechanism may come in many forms, which all provide the intended effect of the present invention (e.g. avoid dead zones that could capture air bubbles). Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims is herewith disclosed.

Further, the terms and phrases used herein are not intended to be limiting, but rather, to provide an understandable description of the invention. The terms "a" or "an," as used herein, are defined as one or more than one. The term plurality, as used herein, is defined as two or more than two. The term another, as used herein, is defined as at least a second or more. The term having, as used herein, is defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A droplet ejection device, comprising:

a pressure chamber;

a nozzle orifice arranged in fluid connection with the pressure chamber;

an actuator system configured to generate a pressure wave in a liquid present in the pressure chamber; and an obstruction member arranged in the pressure chamber in a position opposite to the nozzle orifice, wherein the obstruction member comprises a first surface facing the nozzle orifice, wherein the obstruction member is rigidly coupled to a wall of the pressure chamber via a support, the support being arranged near the first surface of the obstruction member, and wherein the support comprises at least one supporting member located between and attached to an inner wall of the pressure chamber and an outer surface of the obstruction member.

2. The droplet ejection device according to claim 1, wherein the nozzle orifice is arranged for ejecting droplets of the liquid in a first direction, and the obstruction member is arranged for providing a flow of the liquid to the nozzle orifice in a second direction substantially perpendicular to the first direction.

3. The droplet ejection device according to claim 1, wherein the pressure chamber, the obstruction member and the support define a hollow shaped liquid passage.

4. The droplet ejection device according to claim 1, wherein the pressure chamber comprises a liquid chamber arranged between the first surface of the obstruction member and the nozzle orifice.

5. The droplet ejection device according to claim 1, wherein the pressure chamber comprises a feed-through channel extending towards the nozzle orifice, wherein the obstruction member is arranged in the feed-through channel in a position opposite to the nozzle orifice, wherein the obstruction member comprises a second surface facing a wall of the feed-through channel and wherein the obstruction member is rigidly coupled to said wall of the feed-through channel via the support.

6. The droplet ejection device according to claim 5, wherein the feed-through channel, the obstruction member and the support define the hollow shaped liquid passage.

7. The droplet ejection device according to claim 6, wherein the feed-through channel comprises the liquid chamber arranged between first surface of the obstruction member and the nozzle orifice.

8. The droplet ejection device according to claim 5, wherein the support comprises at least one supporting member located between and attached to said wall of the feed-through channel and the second surface of the obstruction member.

9. The droplet ejection device according to claim 1, wherein the droplet ejection device further comprises a structured nozzle inflow mechanism arranged between the obstruction member and the nozzle orifice, wherein the structured nozzle inflow mechanism provides a gradual transition from the hollow shaped liquid passage to the nozzle orifice.

10. The droplet ejection device according to claim 9, wherein the structured nozzle inflow mechanism comprises an internal channel structure connecting the hollow shaped liquid passage with the nozzle orifice.

11. The droplet ejection device according to claims 10, wherein the internal channel structure comprises a nozzle inflow hole, the nozzle inflow hole having an axial axis, the nozzle inflow hole being arranged such that the axial axis is at an angle $\phi$ with a radial axis of the nozzle orifice, the angle $\phi$ being up to 80°.

12. The droplet ejection device according to claim 1, wherein the device comprises a flow passage in fluid connection with the pressure chamber and a circulation system for circulating the liquid through the pressure chamber.

13. A droplet ejection device, comprising:

a pressure chamber;

a nozzle orifice arranged in fluid connection with the pressure chamber;

an actuator system configured to generate a pressure wave in a liquid present in the pressure chamber; and an obstruction member arranged in the pressure chamber in a position opposite to the nozzle orifice, wherein the obstruction member comprises a first surface facing the nozzle orifice, wherein the obstruction member is rigidly coupled to a wall of the pressure chamber via a support, the support being arranged near the first surface of the obstruction member, and wherein the pressure chamber comprises a feed-through channel extending towards the nozzle orifice, wherein the obstruction member is arranged in the feed-through channel in a position opposite to the nozzle orifice, wherein the obstruction member comprises a second surface facing a wall of the feed-through channel and wherein the obstruction member is rigidly coupled to said wall of the feed-through channel via the support.

14. A droplet ejection device, comprising:

a pressure chamber;

a nozzle orifice arranged in fluid connection with the pressure chamber;

an actuator system configured to generate a pressure wave in a liquid present in the pressure chamber; and an obstruction member arranged in the pressure chamber in a position opposite to the nozzle orifice, wherein the obstruction member comprises a first surface facing the nozzle orifice, wherein the obstruction member is rigidly coupled to a wall of the pressure chamber via a support, the support being arranged near the first surface of the obstruction member, and wherein the droplet ejection device further comprises a structured nozzle inflow mechanism arranged between the obstruction member and the nozzle orifice, wherein the structured nozzle inflow mechanism provides a gradual transition from the hollow shaped liquid passage to the nozzle orifice.

* * * * *